US006478219B1

(12) United States Patent
Holley, Jr.

(10) Patent No.: US 6,478,219 B1
(45) Date of Patent: Nov. 12, 2002

(54) CARTON WITH ARTICLE DISPENSER

(75) Inventor: John M. Holley, Jr., Lawrenceville, GA (US)

(73) Assignee: The Mead Corporation, Dayton, OH (US)

( * ) Notice: Subject to any disclaimer, the term of this patent is extended or adjusted under 35 U.S.C. 154(b) by 0 days.

(21) Appl. No.: 09/712,871

(22) Filed: Nov. 15, 2000

(51) Int. Cl.[7] ..... B65D 17/00

(52) U.S. Cl. ..... 229/240; 229/241; 229/242; 229/237; 229/925; 221/305; 206/815

(58) Field of Search ..... 229/122.1, 243, 229/242, 240, 241, 237, 117.27, 925, 244; 221/305, 185, 122.1; 206/427, 815

(56) References Cited

U.S. PATENT DOCUMENTS

| | | | | |
|---|---|---|---|---|
| 2,145,181 A | | 1/1939 | Kennedy | |
| 2,933,229 A | * | 4/1960 | Bensel | 229/122 X |
| 3,019,944 A | * | 2/1962 | Nelson et al. | 221/302 |
| 3,131,847 A | | 5/1964 | Desmond | |
| 3,141,596 A | | 7/1964 | Murphy | |
| 3,189,215 A | | 6/1965 | Currie, Jr. | |
| 3,326,364 A | * | 6/1967 | Waldrop et al. | 229/117.27 X |
| 3,404,828 A | | 10/1968 | Whipperman | |
| 3,578,238 A | | 5/1971 | Schillinger | |
| 3,894,681 A | | 7/1975 | Arneson | |
| D263,204 S | | 3/1982 | Dutcher | |
| 4,364,509 A | | 12/1982 | Holley, Jr. | |
| 4,396,143 A | | 8/1983 | Killy | |
| 4,417,661 A | | 11/1983 | Roccaforte | |
| 4,550,834 A | * | 11/1985 | Fletcher et al. | 229/940 X |
| 5,368,194 A | | 11/1994 | Oliff | |
| 6,176,419 B1 | | 1/2001 | Holley, Jr. | |

* cited by examiner

*Primary Examiner*—Lee Young
*Assistant Examiner*—Tri M. Mai
(74) *Attorney, Agent, or Firm*—Tsugihiko Suzuki

(57) ABSTRACT

A carton includes a first wall, a second wall connected to the first wall along a corner fold line and disposed at an angle with respect to the first wall to define a corner of the carton along the corner fold line, and a tear line formed in the first wall and extending into the second wall to define a tear panel disposed astride the corner fold line. The tear panel includes a push tab connected thereto along a transverse fold line extending transversely of the corner fold line.

12 Claims, 10 Drawing Sheets

10
22
30
28
48
46
12
56
44
42
36
C
16
40
AR1
AR2
82
50

CARTON WITH ARTICLE DISPENSER

BACKGROUND OF THE INVENTION

This invention relates generally to cartons for packaging multiple articles such as beverage cans, bottles and the like, and more particularly to a paperboard carton with an article dispenser for providing an access opening through which articles in the carton may be dispensed one by one.

Beverage cartons with an article dispenser at a carton corner are known in the art. One example is disclosed in U.S. Pat. No. 5,368,194 in which a tear panel is disposed astride a corner fold line. The tear panel is defined by a tear line that is formed in a side wall and extends into a side end flap. The tear panel includes a push tab located within the side end flap while the panel is glued to a bottom end flap that has an extension of the tear line. The extension allows the tear line to reach the bottom wall of the carton. To open the carton, the push tab is pressed and separated from the side end flap. Then, the tear panel is gripped and pulled outwardly, which causes the tear line to break all the way down to the bottom wall. By this means, the tear panel is allowed to swing down together with a part of the bottom end flap, which creates an access opening through which the cans in the carton are exposed. The opening is so dimensioned that at least part of the periphery of the opening serves as a can stopper and prevent the cans from spontaneously rolling out of the carton through the opening. However, this stopper may not fully function once tears develop in the periphery of the opening after some cans have been removed through the opening. Further, the push tab has sometimes been found not user-friendly because it is not easy to separate it from the side end flap. This is because the entire side end flap tends to easily yield to pressing force applied to the push tab and, as a result, sufficient shearing stress is hardly induced along the tear line.

What is needed, therefore, is a carton that is provided with an improved article dispenser that is convenient to use. Such a carton should have a reliable article stopper as well as a user-friendly push tab.

SUMMARY OF THE INVENTION

According to this invention in one form, the article dispenser of a carton is provided with a user-friendly push tab. The carton of the invention comprises first and second walls connected together along a corner fold line and disposed with an angle with respect to each other to define a corner of the carton along the corner fold line. A tear line is formed in the first wall and extends into the second wall to define a tear panel disposed astride the corner fold line. The tear panel includes a push tab connected to the tear panel along a transverse fold line extending transversely of the corner fold line.

This form of the invention brings the push tab to the carton corner which is created by the first and second angularly disposed walls. Therefore, upon pressing of the push tab, the first and second walls act as braces for each other and provide resistance strong enough to induce adequate shearing stress along the tear line. This results in easy separation of the push tab from the first and second walls, which in turn facilitates cutting of the tear panel along the tear line.

In a preferred embodiment of the invention, the transverse fold line may extend transversely across the tear panel so that the push tab is defined between the transverse fold line and a part of the tear line.

In another preferred embodiment, the transverse fold line may comprise a first portion emanating from a portion of the tear line within the first wall and extending to the corner fold line, and a second portion emanating from a portion of the tear line within the second wall and extending to the corner fold line. The first and second portions of the transverse fold line may converge on the corner fold line so that the transverse fold line assumes a generally V-shape when the first and second walls lie flat in a plane. The angle between the first and second portions of the transverse fold line may be an obtuse angle. Alternatively, the transverse fold line may be disposed concave to the push tab when the first and second walls lie flat in a plane.

The present invention in another form provides a blank for forming the aforementioned carton.

The present invention in still another form provides a carton comprising top and bottom walls interconnected by a pair of opposed side walls to form a tubular structure, an end closure structure provided at each end of the tubular structure to at least partially close each end of the tubular structure, and a tear line formed in one of the side walls. One or each of the end closure structures includes a side end flap connected to the one side wall along a corner fold line and extending toward the other side wall. The tear line extends into the side end flap of the respective end closure structure to define a tear panel disposed astride the associated corner fold line. The tear panel includes a push tab connected thereto along a transverse fold line extending transversely of the associated corner fold line. This form of the invention facilitates tearing of the tear panel along the tear line.

The present invention in a further form provides a carton comprising top and bottom walls interconnected by a pair of opposed side walls to form a tubular structure, and an end closure structure provided at each end of said tubular structure to at least partially close each end. One or each of the end closure structures comprises a side end flap, a bottom end flap and a web panel. The side end flap is connected to one of the side walls along a corner fold line and extends toward the other side wall. The side end flap is formed with a tear line for defining a tear panel detachable from both the side end flap and the one side wall. The tear line emanates from the lower edge of the side end flap and extends toward the corner fold line. The bottom end flap is foldably connected to the bottom wall and extends toward the top wall to overlap at least in part with the tear panel. The web panel foldably interconnects the bottom end flap and the tear panel and is disposed in face-contacting relationship with both the outside surface of the bottom end flap and the inside surface of the tear panel. The web panel is detachably connected to one of the bottom end flap and the tear panel.

In this form of invention, the tear panel may be detached from the carton without disturbing the integrity of the bottom end flap. The bottom end flap may, therefore, be allowed to remain in an upright position even after the tear panel is detached and be available as an article retainer or stopper for blocking undesired exit of articles through the access opening created by the detachment of the tear panel.

In a preferred embodiment of the invention, the tear line may extend into the one side wall and terminates at the junction between the one side wall and the bottom wall. The web panel may be separated apart from the bottom wall by an aperture formed in the web panel. Further, the tear panel may be detachably connected to the bottom wall along a frangible line. Such a frangible line may extend between the aperture and tear line.

In another preferred embodiment, the one or each end closure structure may further comprise a second side end flap foldably connected to the other side wall. The second side end flap may extend from the other side wall to the first side end flap to be secured to the first side end flap. The second side end flap may be secured also to the bottom end flap to retain the bottom end flap in an upright position.

The present invention in a further form provides a carton blank for forming the carton of the preceding form of the invention.

According to the present invention in still further form, the article dispenser of a carton is provided with another type of user-friendly tear initiating means. The article dispenser comprises a tear panel defined in a first wall of the carton by a tear line so that when the first wall is cut along the tear line, an access opening is formed to permit access to the articles within the carton. The tear panel includes a push tab connected thereto along a first fold line to facilitate cutting of the first wall along the tear line. The dispenser further comprises a second fold line formed in the first wall and disposed to at least partially surround the push tab such that at least two yielding tabs are defined between the push tab and the second fold line.

Unlike the article dispenser of the first form of the invention, the dispenser of this form of the invention promotes yielding of a part of a carton wall (the yielding tabs) upon pressing on the push tab. When the push tab is pressed, the yielding tabs easily yield to the pressing force and fold inwardly along the second fold line. This causes the yielding tabs to also fold along the tear line at a sharpest possible angle with respect to the push tab, which in turn promotes breaking of the tear line so that the push tab is separated from the yielding tabs.

In a preferred embodiment of the invention of this form, the tear line may be generally V-shaped, and the push tab may be located adjacent to the corner of the V-shaped tear line. The tear line may comprise first and second portions diverging from the corner, and the first fold line may extend between the first and second portions to lie transversely across the tear panel.

In another preferred embodiment, the dispenser may further comprise a cut line extending between the second fold line and the push tab to define a boundary between the yielding tabs.

Other advantages and objects of the present invention will be apparent from the following description, the accompanying drawings, and the appended claims.

DETAILED DESCRIPTION OF THE PREFERRED EMBODIMENTS

Figure 1:
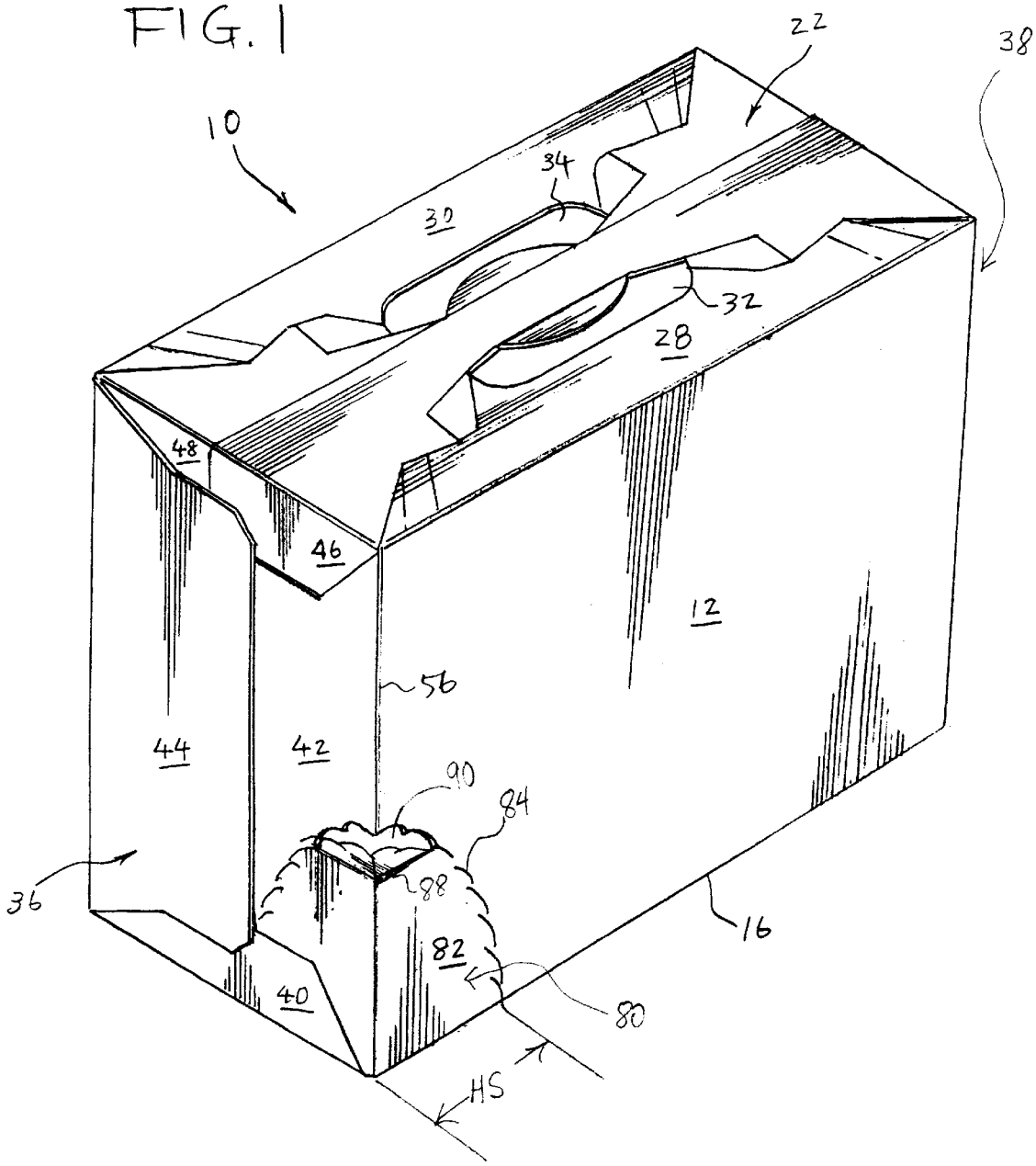
FIG. 1 is a perspective view of an erected carton according to the present invention.
Figure 4:
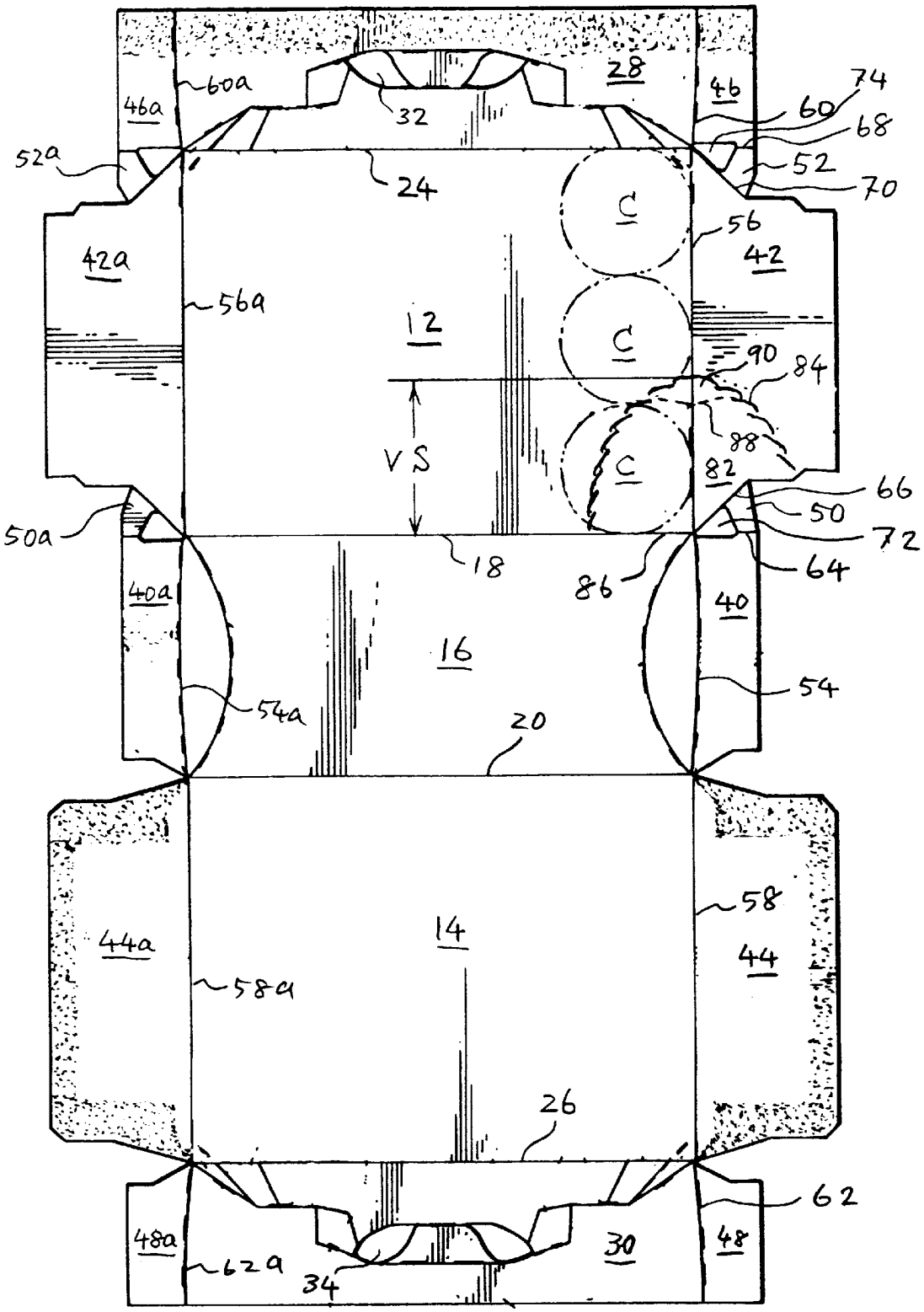
FIG. 4 is a plan view of a blank from which the carton in FIG. 1 is erected.

FIG. 1 shows a carton 10 according to the invention, having an improved article dispenser while FIG. 4 shows a carton blank from which the carton 10 is erected. The carton 10 is designed to package multiple articles such as twelve beverage cans whereas the blank is formed of a foldable sheet material such as paperboard, corrugated board, plastic sheet or the like. Referring to FIGS. 1 and 4, the carton 10 comprises a pair of side walls 12 and 14 foldably joined respectively to the opposite side edges of a bottom wall 16 along fold lines 18 and 20. The side walls 12 and 14 extend upwardly to their respective upper edges and a top wall 22 is foldably joined to the upper edges of the side walls 12 and 14 along fold lines 24 and 26. As a result, an open-ended tubular structure is formed by the top, bottom and side walls 22, 16, 12 and 14. The top wall 22 is formed of two top lap panels 28 and 30 glued together in an overlapping relationship as is known in the art. The stippling along the upper end portion of the blank in FIG. 4 indicates the area where glue is applied for the purpose of securing the top lap panels 28 and 30. The top lap panels 28 and 30 are provided with handle means for carrying the carton. Such handle means is shown in the form of a pair of hand openings 32 and 34 in the top lap panels 28 and 30.

At each end of the aforementioned tubular structure, there is provided an end closure structure shown generally by the numerals 36 and 38. The end closure structures 36 and 38 in FIG. 1 are shown as fully closing the respective ends of the tubular structure; however they may be designed to partially close one or both ends of the carton. An example of a beverage can carton having partially closed ends is shown in U.S. Pat. No. 3,894,681 which is hereby incorporated by reference. The corner windows shown in this U.S. patent may be employed at least at the two upper corners of the carton 10.

Referring to FIG. 4, the end closure structure 36 comprises a bottom end flap 40, a pair of side end flaps 42 and 44, top end flaps 46 and 48 and a pair of web panels 50 and 52. The bottom end flap 40 is foldably joined to the bottom wall 16 along a fold line 54. The side end flaps 42 and 44 are foldably joined to the side walls 12 and 14 along fold lines 56 and 58, respectively. The top end flaps 46 and 48 are foldably joined to the top lap panels 28 and 30 along fold lines 60 and 62, respectively. The web panel 50 interconnects the side end flap 42 and the bottom end flap 40 while the web panel 52 interconnects the side end flap 42 and the top end flap 46. More specifically, the web panel 50 is foldably joined to the bottom end flap 40 along a tear line 64 and to the side end flap 42 along a fold line 66 whereas the web panel 52 is foldably joined to the top end flap 46 along a fold line 68 and to the side end flap 42 along a fold line 70. These web panels 50 and 52 are formed respectively with apertures 72 and 74 for facilitating folding of the top, bottom and side end flaps 46, 40 and 42.

Referring to FIG. 1, the bottom end flap 40 is folded upwardly along the fold line 54 to take the vertical position.

The top end flaps 46 and 48 are glued together in an overlapping relationship and are folded down along the fold lines 60 and 62 to take the vertical position. The side end flaps 42 and 44 are folded toward each other along the fold lines 56 and 58 to take the respective closed positions. In these positions, the side end flaps 42 and 44 are glued together in an overlapping relationship to traverse the respective end of the carton. As a result, the side end flaps 42 and 44 cover the exterior of the top and bottom end flaps 46, 48 and 40 except the upper end area of the top end flaps 46 and 48 and the lower end area of the bottom end flap 40. The web panel 50 is tucked between the side end flap 42 and the bottom end flap 40 while the web panel 52 is tucked between the side end flap 42 and the top end flap 46. In the tucked position, the web panel 50 is folded along the lines 64 and 66 and in a face-contacting relationship with the inside surface of the side end flap 42 and the outside surface of the bottom end flap 40. The web panel 52, when in the tucked position, is folded along the fold lines 68 and 70 and in a face-contacting relationship with the inside surface of the side end flap 42 and the outside surface of the top end flap 46. The side end flap 44 may be secured to the exterior of the top and bottom end flaps 40, 46 and 48 by means of glue applied thereto as shown by the stippling in FIG. 4. However, the side end flap 42 is merely in contact with the top and bottom end flaps 46 and 40 without glue. When the side end flap 42 is folded to the closed position, the web panels 50 and 52 simultaneously take the respective tucked positions.

The other end closure structure 38 comprises a similar set of end flaps connected to the tubular structure in virtually the same way. Therefore, the parts of the structure 38 corresponding to those of the structure 36 are designated by similar reference numerals with the subscript "a", and the description thereof is omitted.

A can dispenser 80 is formed in part in the end closure structure 36 and in part in the side wall 12 as best shown in FIG. 1. The dispenser 80 facilitates customer's access to the cans C (FIGS. 3 and 4) packaged in the carton 10. The dispenser 80, as is described later in more detail, comprises tear lines 64 and 84 and a frangible line 86. However, the "tear line" or the "frangible line" in this application refer to a perforated slit which is formed in the sheet material from which the carton is formed and functions to split a part of the paperboard material in two. The "perforated slit" refers to a line consisting of a series of short slits or cuts arranged at spacings and ready to split along the line when subject to external force.

Referring further to FIG. 1, the tear line 84 emanates from the lower edge of the side end flap 42, extends upwardly and curves toward the corner fold line 56. The tear line 84 then extends into the side wall 12, curves downwardly and terminates on the junction (i.e., fold line 18) between the side wall 12 and the bottom wall 16. The frangible line 86 connects between the terminal end of the tear line 84 and the aperture 72 as best shown in FIG. 4. The frangible line 86 is shown as being in registry with the fold line 18. However, the frangible line 86 may be formed within the side wall 12 such that it extends between the aperture 72 and a location along the tear line 84. The sheet material surrounded by the tear line 84, the frangible line 86, the aperture 72 and the fold line 66 provides a tear panel 82 that is a part of the dispenser 80 and may be torn off of the carton to define an access opening in the carton. As is apparent from FIGS. 1 and 4, the tear panel 82 is formed in part from the side end flap 42 and in part from the side wall 12 so that it is located astride the corner fold line 56. The maximum vertical size VS of the tear panel 82, typically, is greater than the maximum diameter of the cans C in the carton and less than a size twice as large as the can diameter. A preferred vertical size VS of the tear panel 82 is such that push tab 90 that will be described later is disposed at the location between the lowermost can C and the second lowermost can C as viewed in FIG. 4. The maximum horizontal size HS of the tear panel 82 may be around the size of the can diameter, and preferably less than the can diameter and greater than a half of the can diameter.

The tear panel 82 is formed with a generally V-shaped fold line 88 that extends transversely of the corner fold line 56. The fold line 88 defines at the upper end portion of the tear panel 82 a push tab 90 for facilitating cutting of the tear panel 82. State differently, the push tab 90 is hingedly connected to the tear panel 82 along the fold line 88. The portion of the fold line 88 within the side wall 12 and the portion thereof within the side end flap 42 diverge upwardly from the corner fold line 56 to define an obtuse angle therebetween as viewed in FIG. 4. However, the fold line 88 may be a smoothly curved line rather than the V-shaped line as long as it lies concave to the push tab 90 when the side wall 12 and the side end flap 42 lie flat in the same plane.

It should be appreciated that because a part of the tear panel 82 is formed from the lower portion of the side end flap 42, the tear panel 82 is connected to the bottom end flap 40 through the web panel 50, and in fact the web panel 50 is tucked between the tear panel 82 and the bottom end flap 40.

In order to utilize the dispenser 80, the push tab 90 is manually pressed inwardly of the carton till the length of the tear line 84 near the corner fold line 56 breaks to sever the push tab 90 from the carton. This severing is facilitated as a result of the arrangement in which the push tab 90 is located astride the corner fold line 56. At the corner along the fold line 56, the side wall 12 and the side end flap 42 act as braces for each other and provide in response to pressing on the push tab 90 resistance strong enough to induce adequate shearing stress along the tear line 84. The push tab 90 is easily severed as a result also of the fact that the push tab 90 is located within a single wall area where no layer of sheet material forms the carton wall but the side wall 12 and the side end flap 42.

Figure 2:
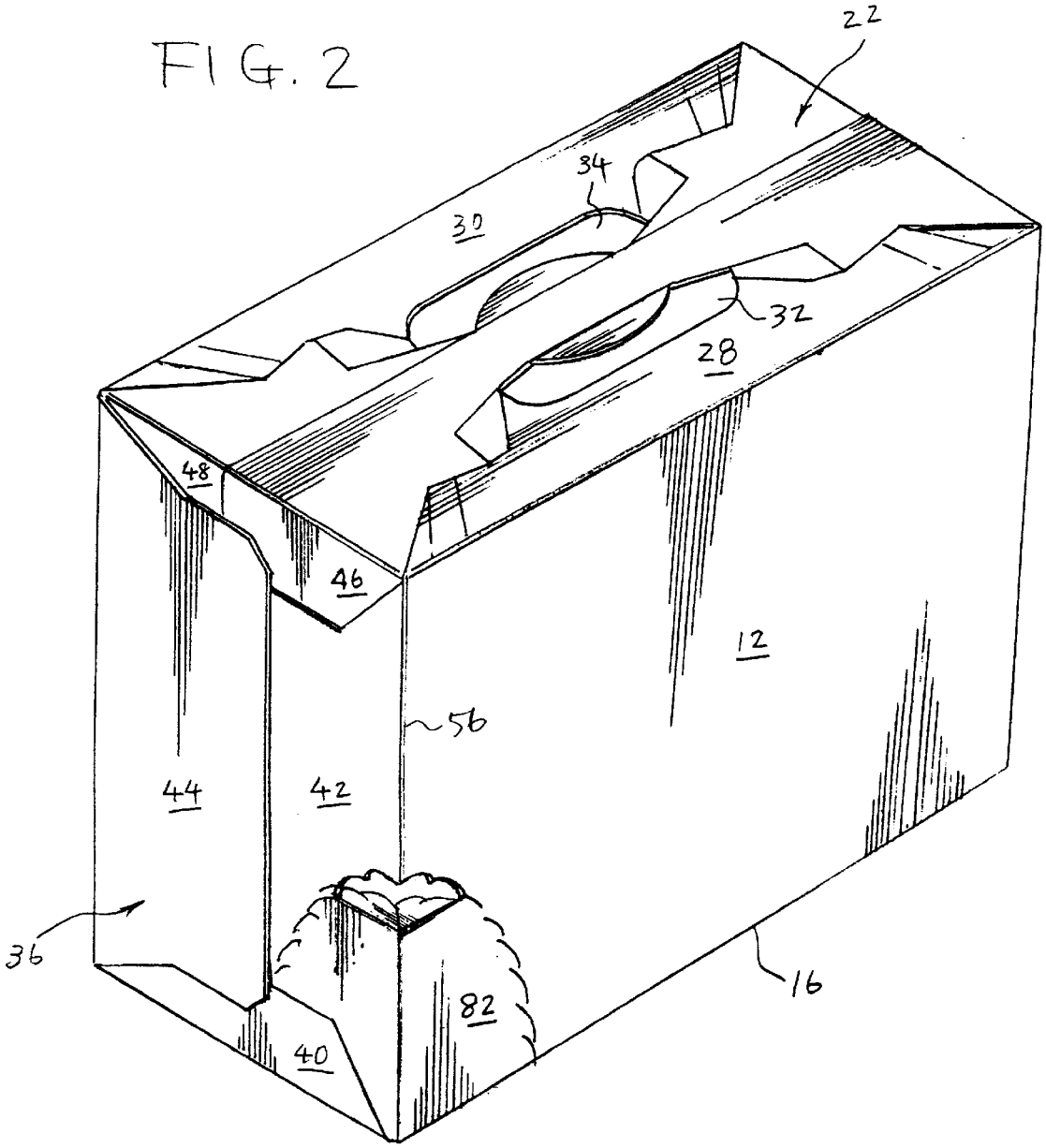
FIG. 2 is a perspective view of the carton of FIG. 1, showing the push tab pushed into the carton to initiate cutting of the tear panel.
Figure 3:
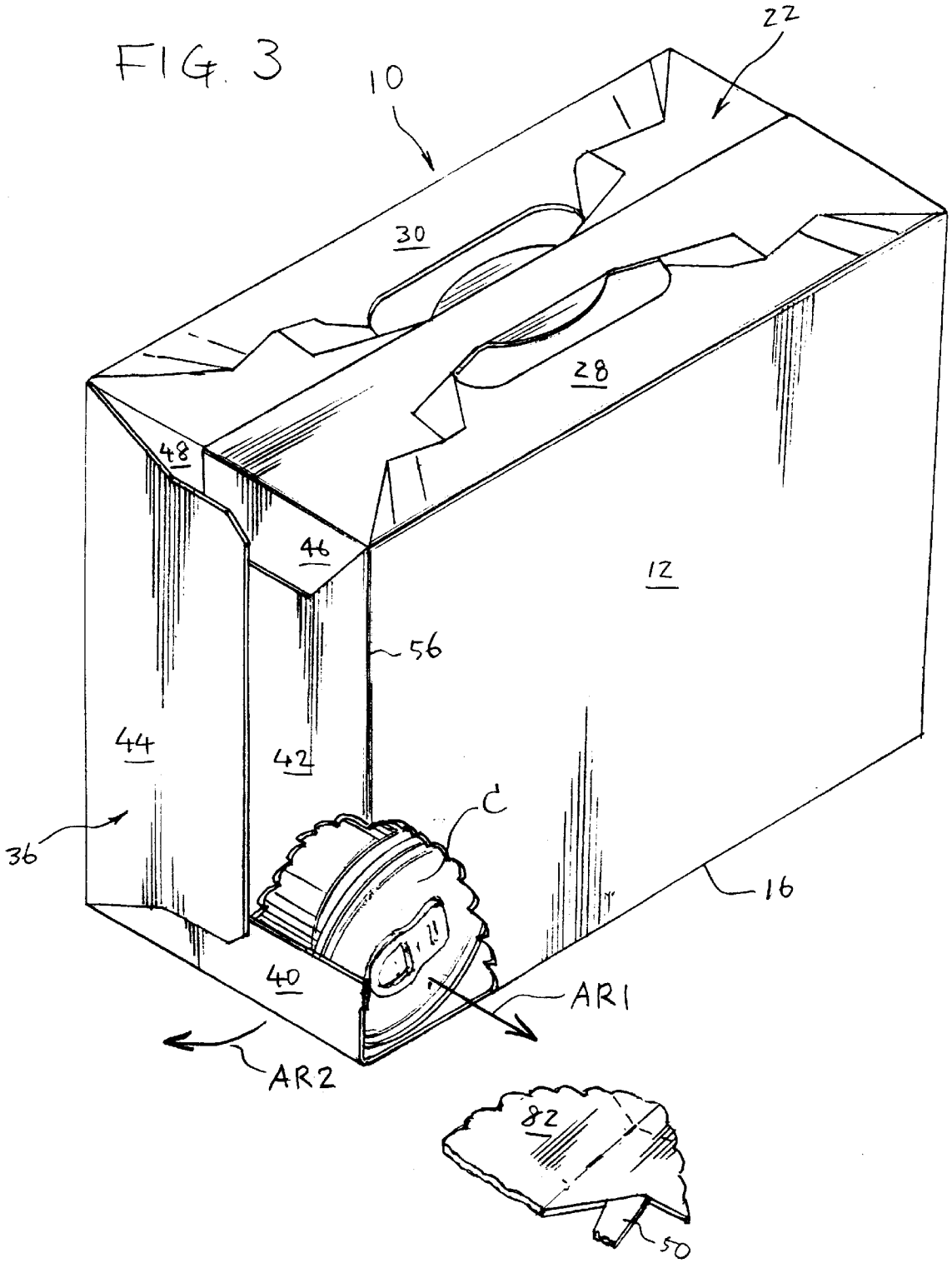
FIG. 3 is a perspective view of the carton in FIG. 1, showing the access opening formed in the carton by severance of the tear panel.

Upon the severance from the carton, the push tab 90 is folded inwardly along the fold line 88. This is best shown in FIG. 2. The tear panel 82 is then caught at the folded tab 90 by a finger and pulled outwardly and downwardly, which completes breaking of the tear line 84 to its opposite lower ends. Successive outward pulling of the tear panel 82 breaks the tear line 64 and then the frangible line 86. This causes the tear panel 82 to be tom out of the carton together with the web panel 50 as shown in FIG. 3 wherein the adjacent can C in the carton 10 is partially exposed through an access opening created by the removal of the tear panel 82. The bottom end flap 40 remains undisturbed in the upright position even after the removal of the tear panel 82 because the side end flap 44 adhesively holds the bottom end flap 40 in position and the web panel 50 has been easily detached due to the tear line 64. As a result, the bottom end flap 40 serves as a stopper for preventing the cans C from spontaneously rolling out of the carton 10 through the access opening.

Removal of the adjacent can C from the carton 10 may be seen by referring to FIG. 3. The user may place two fingers on diagonally opposed portions on the side wall of the adjacent can C, and move the can C in the direction shown by the arrow AR1 through the access opening while slightly pivoting the can in the direction of the arrow AR2. The pivoting force flexes the bottom end flap 40, thereby permitting the can C to be pulled outwardly through the access opening. Once the adjacent can C is removed, cans positioned above the removed can will drop downwardly, thereby presenting another can for removal from the carton.

In the illustrated embodiment, the tear panel 82 is detachably connected to the bottom end flap 40 through the web panel 50 and to the bottom wall 16 along the frangible line 86 to allow itself to be completely severed from the carton 10. However, the tear panel 82 may be detachably connected to the web panel 50 by replacing the fold line 66 with a tear line. In such an arrangement, the tear line 64 may, of course, be replaced by a fold line. Alternatively, both the tear line 64 and the frangible line 86 may be replaced by fold lines so that the tear panel 82 may remain hingedly connected to the carton 10 after the tear line 84 has been broken. In such an arrangement, the tear panel 82 may be manually swung downwardly about the fold line 18 till it lies in the plane of the bottom wall 16. As the tear panel 82 is lowered, the web panel 50 is unfolded to extend between the tear panel 82 and the bottom end flap 40. This forms a dispensing spout projecting in the direction of the arrow AR1. The cans C may then be taken out of the carton 10 one by one through the access opening in the same way as described in the preceding paragraph.

The corner on which the tear panel 82 may be located is not limited to the corner where two carton walls meet at a right angle. The tear panel 82 may also be used on corners where two walls meet at an angle either less or greater than a right angle.

Figure 5:
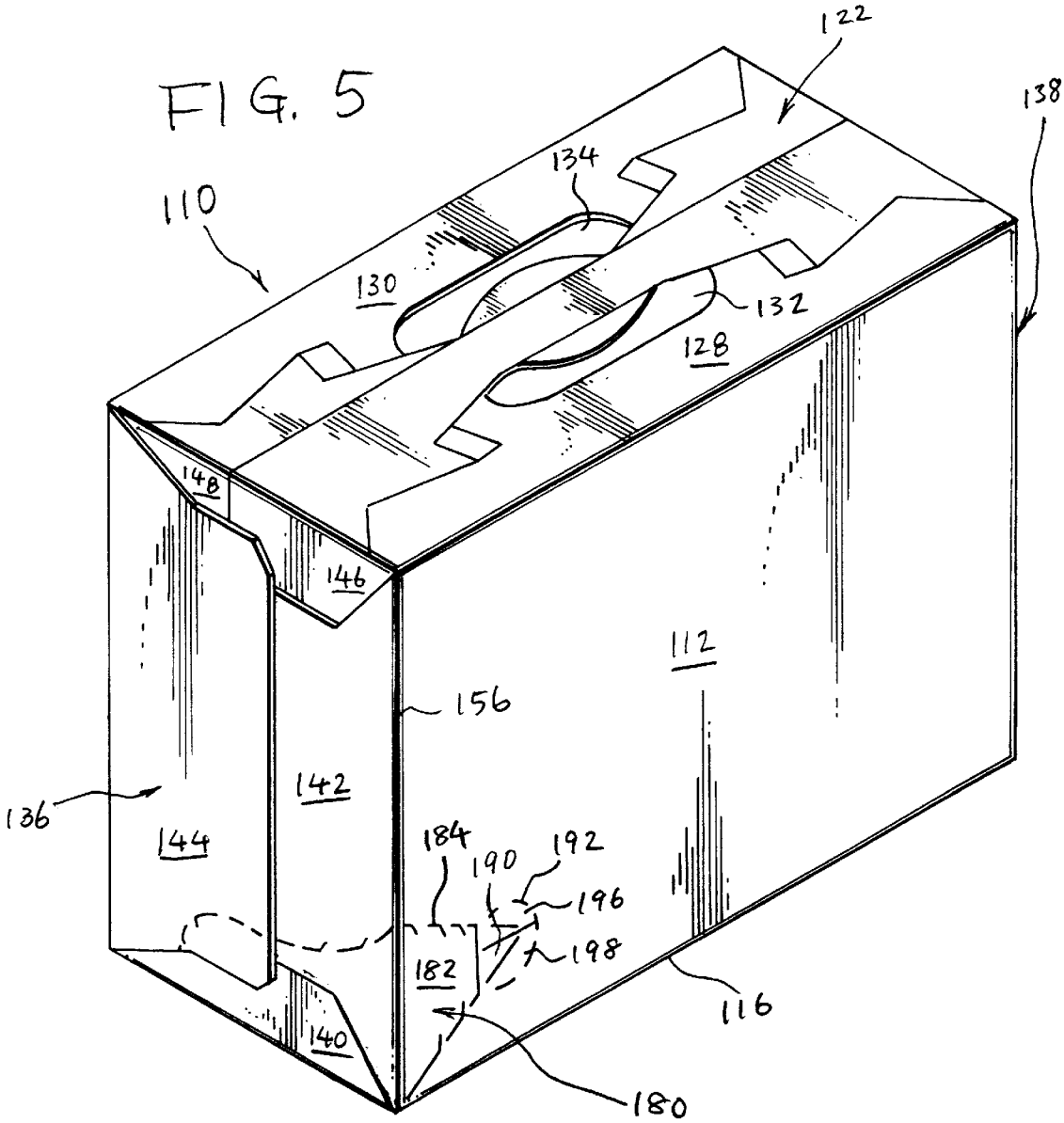
FIG. 5 is a perspective view of an erected carton of an alternative embodiment according to the present invention.
Figure 6:
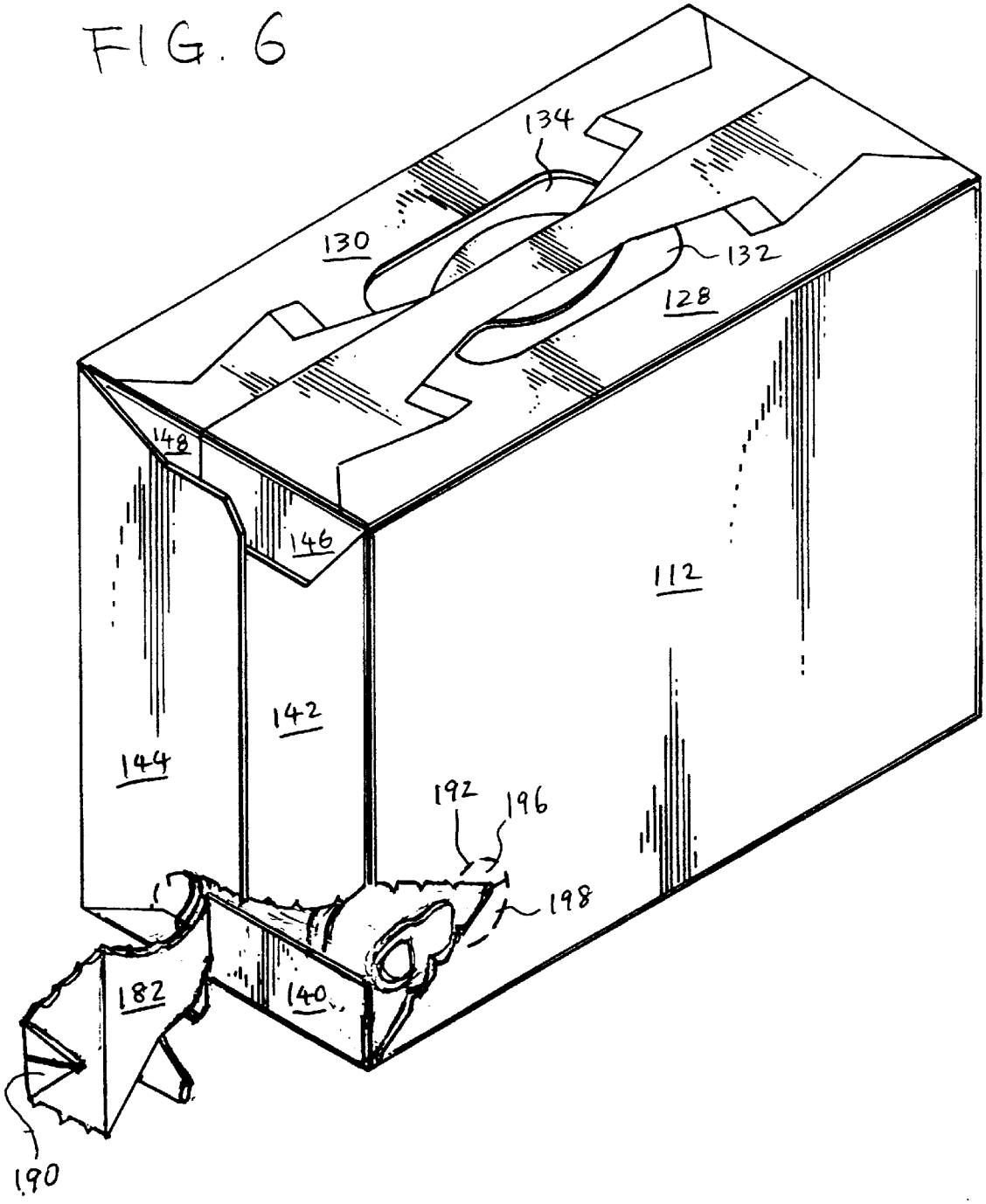
FIG. 6 is a perspective view of the carton of FIG. 5, showing the tear panel severed halfway from along the tear line.
Figure 7:
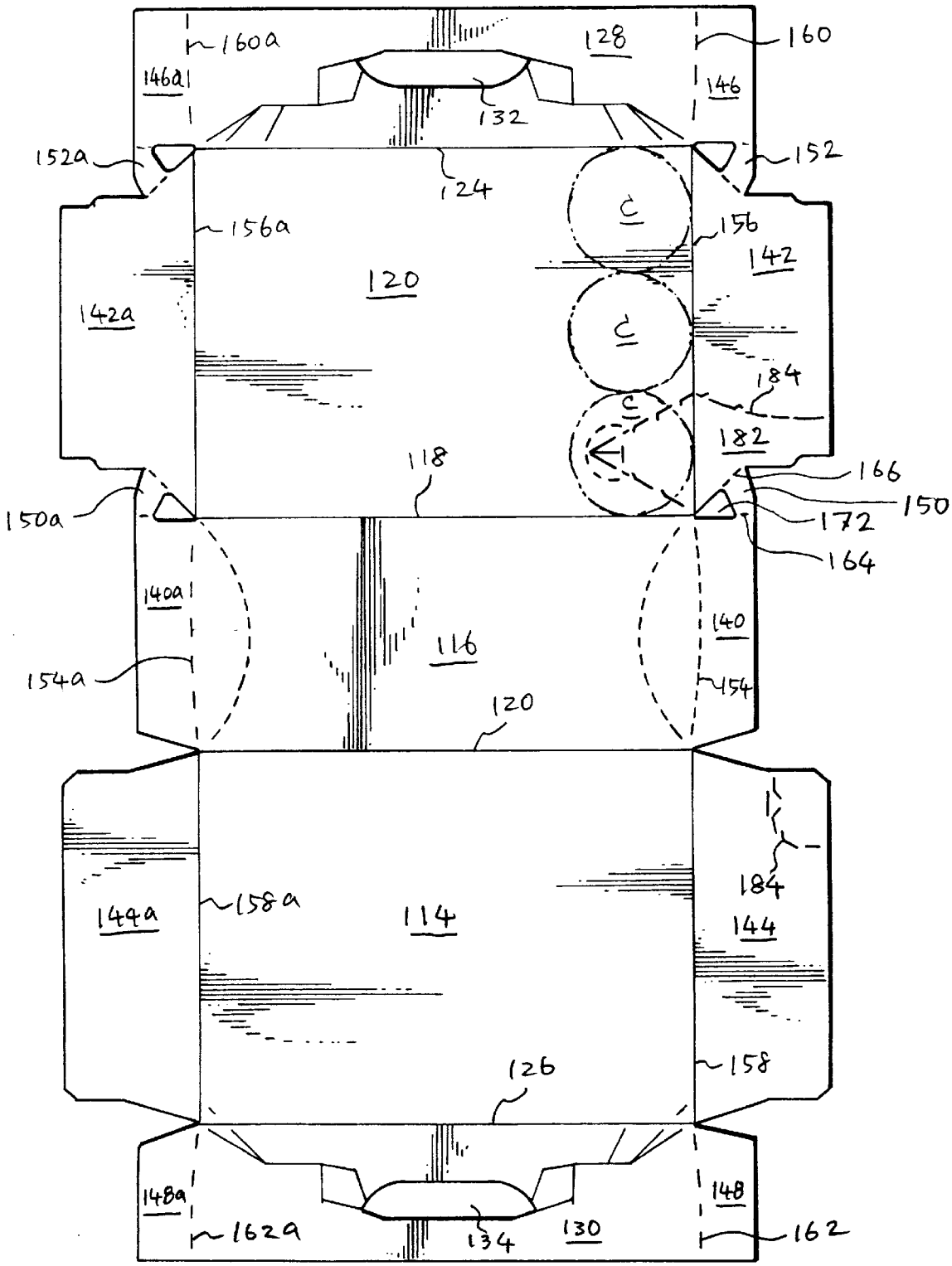
FIG. 7 is a plan view of a blank from which the carton of FIG. 5 is erected.

FIGS. 5–8 illustrate an alternative embodiment of carton of the invention. The dispenser 180 of the carton 110 of this embodiment has a partially V-shaped tear line 184 in place of the inverted U-shaped tear line in FIG. 1. Referring to FIGS. 5 and 7, the tear line 184 emanates from the lower edge of the side end flap 144, extends into the side end flap 142 and reaches the corner fold line 156. The tear line 184 then extends obliquely downwardly into the side wall 112, bends downwardly at an acute angle and terminates at the lower corner of the side wall 112 adjacent to the aperture 172. The tear panel 182 that is defined by the tear line 184 is formed in part from the side end flap 144, in part from the side end flap 142 and in part from the side wall 112. The web panel 150 is connected to the tear panel 182 along a fold line 166 and to the bottom end flap 140 along a tear line 164. However, the fold line 166 may be replaced by a tear line while the tear line 164 may be replaced by a fold line.

Figure 8:
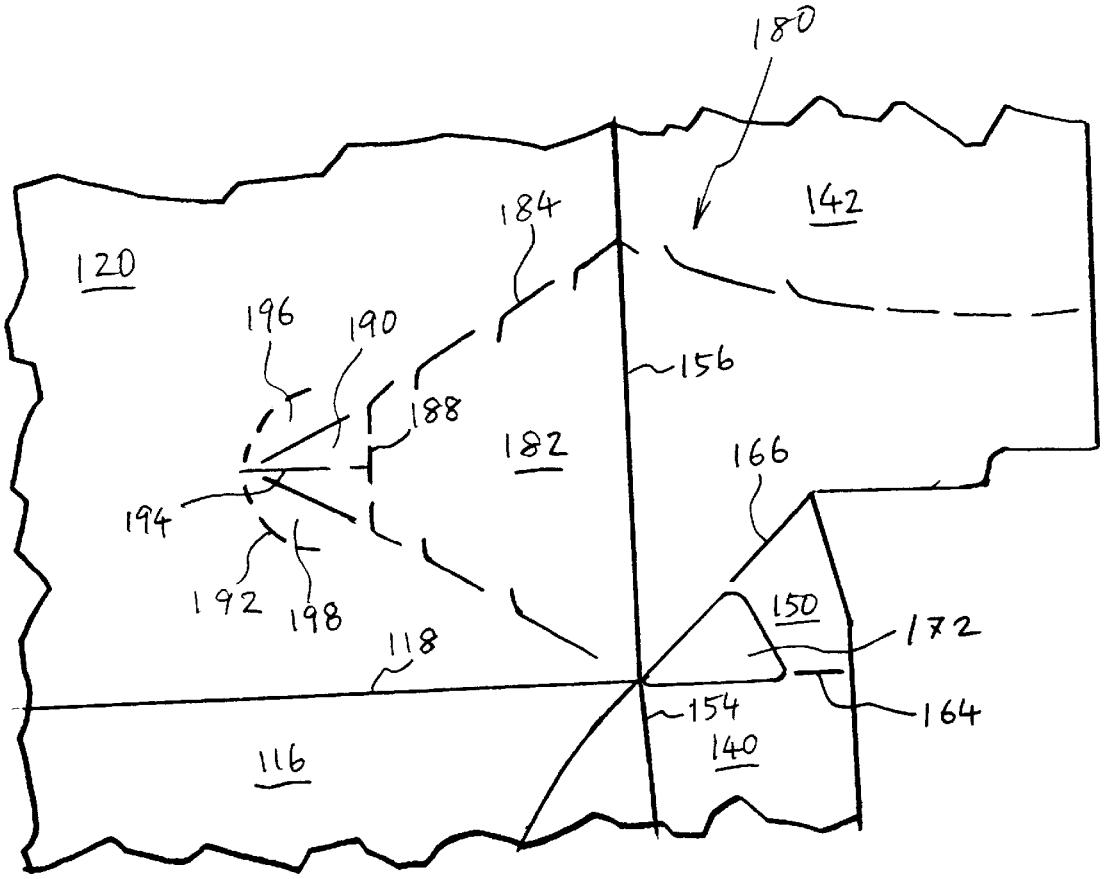
FIG. 8 is an enlarged fragmentary plan view of the blank in FIG. 7, showing the article dispenser.

Referring to FIG. 8, the tear panel 182 is formed with a fold line 188 that extends vertically across of the triangular portion of the tear panel 182 that is defined by the V-shaped portion of the tear line 184. Unlike the fold line 88 in FIG. 1, the fold line 188 is formed entirely within the side wall 112 and thus does not intersect the corner fold line 156. The fold line 188 defines a hingedly connected push tab 190 adjacent to the tip end of the tear panel 182 or near the corner of the V-shaped portion of the tear line 184. The dispenser 180 further comprises an arched outer fold line 192 formed in the side wall 112. The outer fold line 192 is arranged to partially surround the push tab 190. A cut line 194 extends between the outer fold line 192 and the push tab 190 to split the material between the tab 190 and the line 192. As a result, a pair of yielding tabs 196 and 198 are defined between the tab 190 and the fold line 192. In FIG. 8, the cut line 194 is shown as extending into the push tab 190. However, the portion of the cut line 194 within the push tab 190 may be omitted from the push tab 190. The location of the push tab 190 relative to the cans in the carton 110 is such that the push tab 190 is registered with the indentation at a can end such as the end of the lowermost can C as shown in FIG. 7. The remainder of the carton 110 is virtually identical to the carton of the preceding embodiment, and thus the parts of the carton 110 corresponding to those of the preceding embodiment are denoted by similar reference numerals that are greater by 100 than the corresponding parts of the preceding embodiment and the description thereof is omitted.

Removal of the cans C using the dispenser 180 can be seen referring to FIG. 6. The user presses inwardly on the push tab 190, which is easily separated from the side wall 120 due to the arrangement including the yielding tabs 196 and 198. When the push tab 190 is pressed, the yielding tabs 196 and 198 yield to the pressing force and fold inwardly along the outer fold line 192. At the same time, the yielding tabs 196 and 198 fold also along the tear line 184. This causes the push tab 190 to be folded at a sharpest possible angle with respect to the yielding tabs 196 and 198, which promotes breaking of the portion of the tear line 184 flanked by the yielding tabs 196 and 198.

Upon the separation from the side wall 112, the push tab 190 is folded inwardly along the fold line 188. The tear panel 182 is then caught at the folded tab 190 by a finger and pulled outwardly till breaking of the tear line 184 is completed to its opposite ends. The tear line 164 also breaks as a result of the pulling action on the tear panel 182. When the tear panel 182 is removed, the adjacent can C in the carton 110 is partially exposed through the access opening. Removal of the adjacent can C may be achieved in the virtually same manner as in the preceding embodiment.

Figure 9:
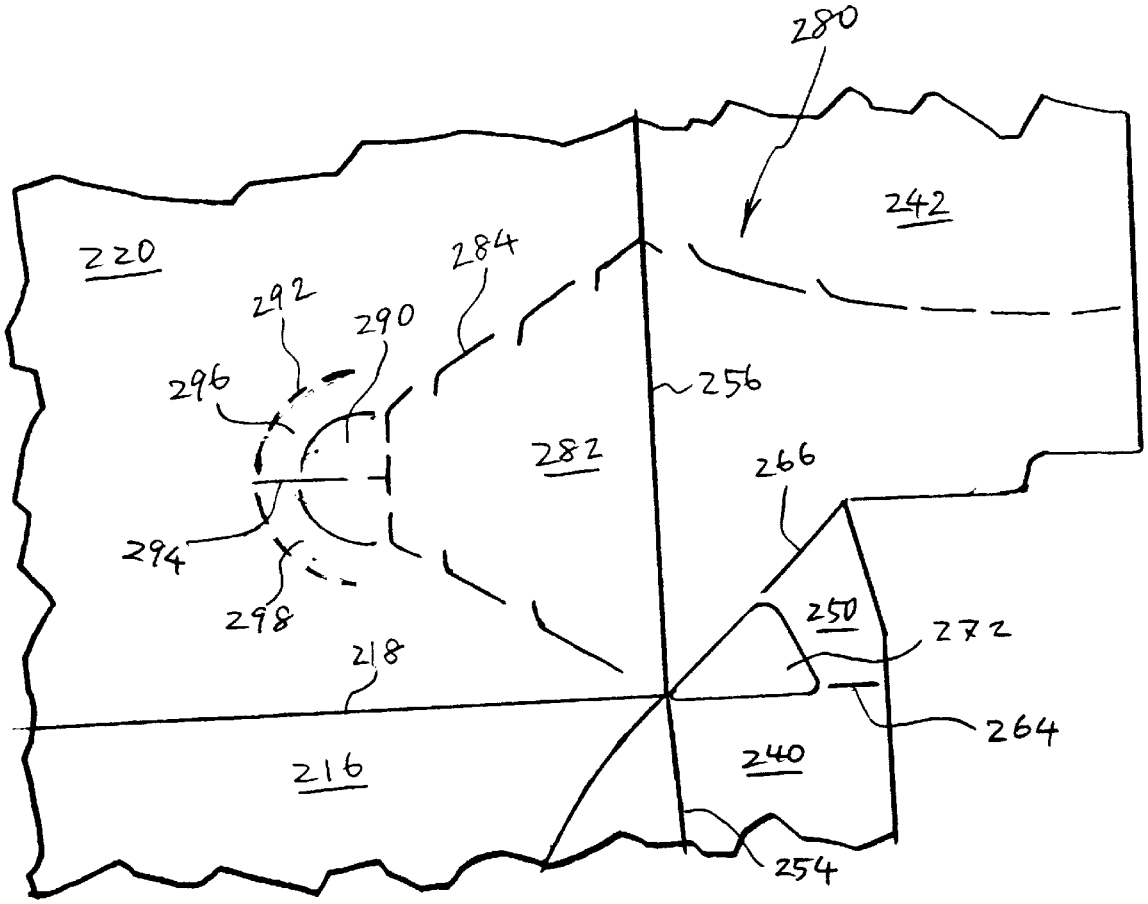
FIG. 9 is a fragmentary plan view similar to FIG. 8, showing a modified form of the article dispenser in FIG. 8.

FIG. 9 illustrates a modified form of the dispenser in FIG. 8. The tear panel 282 of the dispenser 280 in this modification has a rounded tip end defined by the rounded corner portion of the tear line 284. The remainder of the dispenser 280 is virtually identical to that in FIG. 8. Thus, the parts of the dispenser 280 corresponding to that in FIG. 8 are denoted by similar reference numerals that are greater by 100 than the corresponding parts in FIG. 8 and the description thereof is omitted.

Figure 10:
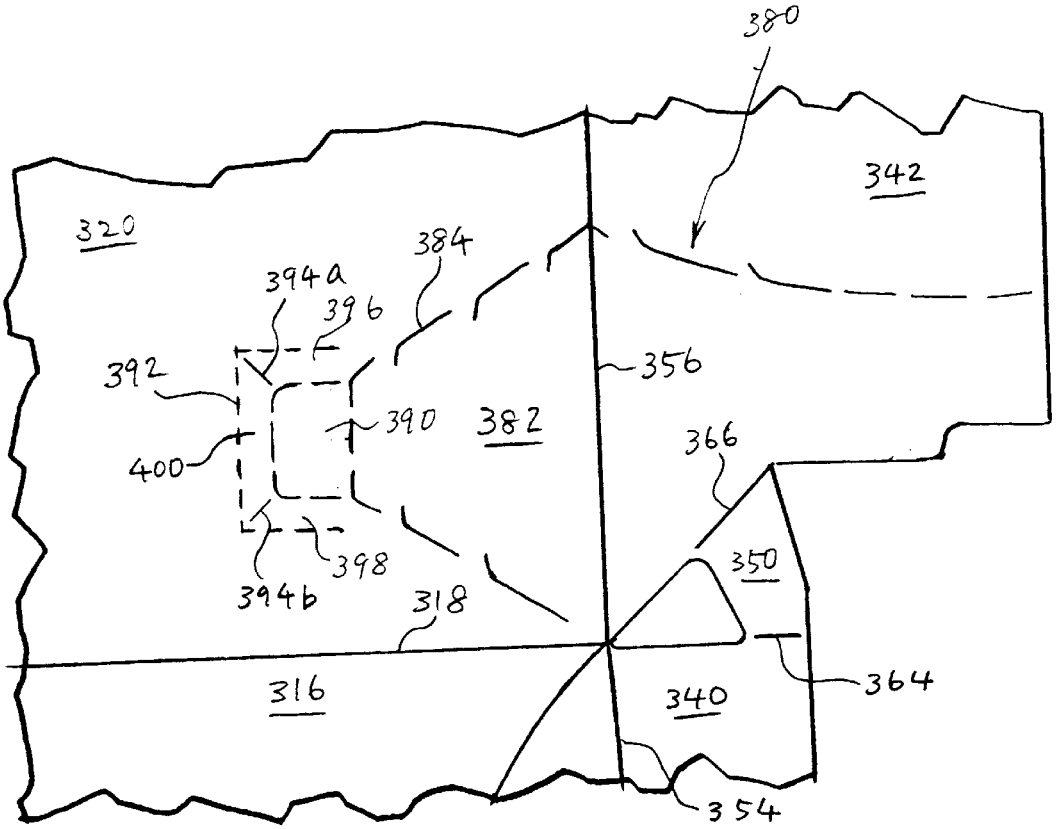
FIG. 10 is a fragmentary plan view similar to FIG. 8, showing another modified form of the article dispenser in FIG. 8.

FIG. 10 illustrates another modified form of the dispenser in FIG. 8. The tear panel 382 of the dispenser 380 in this modification has a generally squared tip end defined by the generally squared corner portion of the tear line 384. The outer fold line 392 is also squared to correspond to the shape of the corner portion of the tear line 384. Two separate cut lines 394*a* and 394*b* extend between the outer fold line 392 and the push tab 390. As a result, three yielding tabs 396, 398 and 400 are defined between the outer fold line 392 and the push tab 390. The remainder of the dispenser 380 is virtually identical to that in FIG. 8. Thus, the parts of the dispenser 380 corresponding to that in FIG. 8 are denoted by similar reference numerals that are greater by 200 than the corresponding parts in FIG. 8 and the description thereof is omitted.

From the foregoing, it can be seen that there has been provided by the subject invention a new carton for multiple articles such as cans or the like having an improved dispenser. It is apparent from a review of the specification and a study of the drawing that many changes may be made in the various features of the invention without departing from the spirit and scope of the invention, and the invention is not to be limited to the exact features which have been shown by way of illustration only. For example, it should be appreciated that the side end flaps at either end of the carton may be secured together by means of known mechanical locks consisting of locking tabs and locking apertures. Such side end flaps with mechanical locks may be seen in U.S. Pat. No. 4,364,509 which is hereby incorporated by reference. It should be also appreciated that the carton of the invention may be formed with beveled corner panels each interposed and foldably connecting between a top or bottom end flap and the adjacent one of the top and bottom walls. The beveled corner panels are shown in U.S. Pat. No. 4,364,509. It should be further appreciated that as used herein, the terms "top", "bottom" and "side" with respect to the panels or walls of the carton or carton blank are relative terms, and that the carton may be re-oriented as necessary or as desired.

What is claimed is:

1. A carton comprising a first wall and an article dispenser, said article dispenser comprising:

a tear panel defined in said first wall by a tear line so that when said first wall is cut along said tear line, an access opening is formed to permit access to articles within said carton, said tear panel including a push tab connected thereto along a first fold line to facilitate cutting of said first wall along said tear line; and a second fold line formed in said first wall and disposed to at least partially surround said push tab such that at least two yielding tabs are defined between said push tab and said second fold line, wherein said push tab includes a hinged end, an opposed tip end and a pair of opposed side edges, said hinged end being defined by said first fold line, said tip end being located opposite to said first fold line, said opposed side edges each extending between said first fold line and said tip end, said tip end and said opposed side edges being defined by a portion of said tear line, said push tab being flanked by said at least two yielding tabs along said opposed side edges and at said tip end.

2. The carton according to claim 1 wherein said tear line is generally V-shaped, and said push tab is located adjacent to a corner of said V-shaped tear line.

3. The carton according to claim 2 wherein said tear line comprises first and second portions diverging from said corner, and said first fold line extends between said first and second portions to lie transversely across said tear panel.

4. The carton according to claim 1 wherein said dispenser further comprises a cut line extending between said second fold line and said push tab to define a boundary between said yielding tabs.

5. A carton comprising a first wall and an article dispenser, said article dispenser comprising:

a tear panel defined in said first wall by a tear line so that when said first wall is cut along said tear line, an access opening is formed to permit access to articles within said carton, said tear panel including a push tab connected thereto along a first fold line to facilitate cutting of said first wall along said tear line; and a second fold line formed in said first wall and disposed to at least partially surround said push tab such that at least two yielding tabs are defined between said push tab and said second fold line, wherein said push tab is defined by said first fold line and a portion of said tear line, said push tab being flanked by said at least two yielding tabs entirely along said portion of said tear line.

6. The carton according to claim 5 wherein said tear line is generally V-shaped, and said push tab is located adjacent to a corner of said V-shaped tear line.

7. The carton according to claim 6 wherein said tear line comprises first and second portions diverging from said corner, and said first fold line extends between said first and second portions to lie transversely across said tear panel.

8. The carton according to claim 5 wherein said dispenser further comprises a cut line extending between said second fold line and said push tab to define a boundary between said yielding tabs.

9. A carton comprising top and bottom walls interconnected by a pair of opposed side walls to form a tubular structure, and an end closure structure provided at each end of said tubular structure to at least partially close said each end, one or each of said end closure structures comprising:

a pair of first and second side end flaps, said first side end flap being connected to one of said side walls along a corner fold line-and extending toward the other side wall, said second side end flap being connected to said other side wall and disposed in an overlapping relationship with said first side end flap, said first and second side end flaps being formed with a tear line for defining a tear panel detachable from said first and second side end flaps and said one side wall, said tear line emanating from a lower edge of said second side end flap and extending toward said corner fold line into said first side end flap;

a bottom end flap foldably connected to said bottom wall, said bottom end flap extending toward said top wall and being secured to said second side end flap to be retained in an upright position; and a web panel foldably interconnecting said bottom end flap and said tear panel and disposed in face-contacting relationship with both an outside surface of said bottom end flap and an inside surface of said tear panel, said web panel being detachably connected to one of said bottom end flap and said tear panel.

10. The carton according to claim 9 wherein said tear line intersect said corner fold line, extends into said one side wall and terminates at a lower corner of said one side wall adjacent to said web panel.

11. The carton according to claim 10 wherein said web panel is separated apart from said bottom wall by an aperture formed in said web panel.

12. The carton according to claim 11 wherein said lower corner is located adjacent to said aperture.

* * * * *